US005085425A

United States Patent [19]

Collins et al.

[11] Patent Number: 5,085,425

[45] Date of Patent: Feb. 4, 1992

[54] WORKOUT HORSE

[75] Inventors: Charles S. Collins, 1 Ulverscroft Cottage, Bakeham Lane, Englefield Green, Egham, Surrey; Roger M. Whelan, Bracknell, both of England

[73] Assignee: Charles S. Collins, Egham, England

[21] Appl. No.: 547,044

[22] Filed: Jul. 2, 1990

[30] Foreign Application Priority Data

Jul. 3, 1989 [GB] United Kingdom ..... 8915233

[51] Int. Cl.[5] ..... A63G 13/08

[52] U.S. Cl. ..... 272/53.1

[58] Field of Search ..... 272/52, 52.5, 53.1, 272/53.2, 55, 56, 48; 5/108, 109; 297/260, 281

[56] References Cited

U.S. PATENT DOCUMENTS

| | | | |
|---|---|---|---|
| 1,147,883 | 7/1915 | Olfort . | |
| 2,589,570 | 3/1952 | Phillips | 272/53.1 |
| 2,634,975 | 4/1953 | Hahs | 272/53.1 |
| 2,637,554 | 5/1953 | Terreson | 272/53.1 |
| 2,668,579 | 2/1954 | Swengel . | |
| 2,675,234 | 4/1954 | Reames | 272/53.1 X |
| 2,722,418 | 11/1955 | Small | 272/52.1 |
| 3,062,541 | 11/1962 | Price | 272/53.1 |
| 3,204,953 | 9/1965 | Ahrens . | |
| 4,566,688 | 1/1986 | Monica . | |
| 4,575,071 | 3/1986 | Swengel et al. . | |

FOREIGN PATENT DOCUMENTS

| | | |
|---|---|---|
| 640042 | 12/1936 | Fed. Rep. of Germany . |
| 749891 | 6/1956 | United Kingdom . |

*Primary Examiner*—Richard E. Chilcot, Jr.

*Attorney, Agent, or Firm*—Beveridge, DeGrandi & Weilacher

[57] ABSTRACT

A workout horse includes a stationary base frame, a body portion on which a rider sits mounted on an upper support which is movable relative to the base frame, and drive device interconnecting the base frame and the upper support for continuously reciprocating the upper support and thereby the body portion forwards and backwards relative to the base frame along an intended rotary path. For providing the body portion with the simulated movement of a horse at one end of the upper movable support a rigid link is pivotally connected between the upper support and the base frame, the other end of the upper support being supported above the base frame by a separate linkage spaced from the rigid link in the direction of movement of the upper support, and the drive device is mounted offset from the linkage in the direction of movement and comprises two cranks driven by an electric motor, the first crank being connected directly to the upper support to effect the reciprocal motion of the upper support, and the second crank being connected to said linkage between the upper support and the base frame whereby substantially horizontal driving movement of the second crank effects vertical extension or contraction of the linkage thereby changing the attitude of the upper support relative to the base frame, the combined action of the first and second cranks effecting a movement of the upper support and thereby the body portion which simulates the movement of a horse. In a particular embodiment the horse is for use by polo players and the drive device effects a movement of the upper support and thereby the body portion which simulates the natural cantering movement of a polo pony.

9 Claims, 7 Drawing Sheets

WORKOUT HORSE

This invention relates to a workout horse. More particularly but not exclusively, the invention relates to a workout horse for use by polo players.

It is known for a polo player to workout on a static, replica of a horse, conventionally made of wood, which is positioned at the centre of a dish shaped surface so that when the polo ball is hit, the ball will remain within the confines of the surface and tend to roll back towards the player on the horse.

A mechanical bucking steer is also known. In this case the replica steer spins and is activated to provide an intermittent bucking motion.

According to the invention there is provided a workout horse comprising a stationary base frame, a body portion on which a rider sits mounted on an upper support which is movable relative to the base frame, and drive means interconnecting the base frame and the upper support for continuously reciprocating the upper support and thereby the body portion forwards and backwards relative to the base frame along an intended rotary path, wherein for providing the body portion with the simulated movement of a horse at one end of the upper movable support a rigid link is pivotally connected between the upper support and the base frame, the other end of the upper support being supported above the base frame by a separate linkage spaced from the rigid link in the direction of movement of the upper support, and the drive means is mounted offset from the linkage in said direction of movement and comprises two cranks driven by an electric motor, the first crank being connected directly to the upper support to effect said reciprocal motion of the upper support, and the second crank being connected to said linkage between the upper support and the base frame whereby substantially horizontal driving movement of the second crank effects vertical extension or contraction of the linkage thereby changing the attitude of the upper support relative to the base frame, the combined action of the first and second cranks effecting a movement of the upper support and thereby the body portion which simulates the movement of a horse.

Preferably said linkage comprises a pair of links pivotally attached to the upper support and the base frame respectively and pivotally connected together about a transverse axis disposed between the upper support and the base frame, and on which axis said pair of links are pivotally attached to the second crank.

It is also preferred that the two cranks comprise crank wheels mounted on a common output shaft of the electric motor, the first crank wheel having a connecting rod pivotally connected at its free end to the upper support, and the second crank wheel having a connecting rod pivotally connected to said linkage. Preferably the relative rotary position of the two crank wheels on the common shaft is infinitely adjustable.

The drive means is preferably mounted on the base frame between said link and said linkage.

Preferably the horse is for use by polo players and the drive means effects a movement of the upper support and thereby the body portion which simulates the natural smooth cantering movement of a polo pony.

The body portion is preferably carried on a support column extending upwardly from the upper support.

In a particular embodiment of the invention, the body portion may have a main portion on which the rider sits, a neck portion integral with the main portion and a head portion pivotally mounted on the end of the neck portion, reins for pivoting the head portion, and indicator means which indicate to the rider when the head portion is pivoted beyond a predetermined limit.

One particular use for the workout horse according to the invention is to enable the rider to practice hitting an object, e.g. for a polo player or potential polo player to practice hitting a polo ball. For this purpose, the workout horse may be provided in combination with a known dish shaped surface on which, e.g. at its centre, the workout horse is stood or preferably fixed. The rider then sits on the horse for practicing hitting polo balls. The contour of the surface is designed to retain the balls within the confines of the surface and to return them towards the horse.

By way of example, a specific embodiment in accordance with the invention will be described with reference to the accompanying diagrammatic drawings in which.

Figure 1:
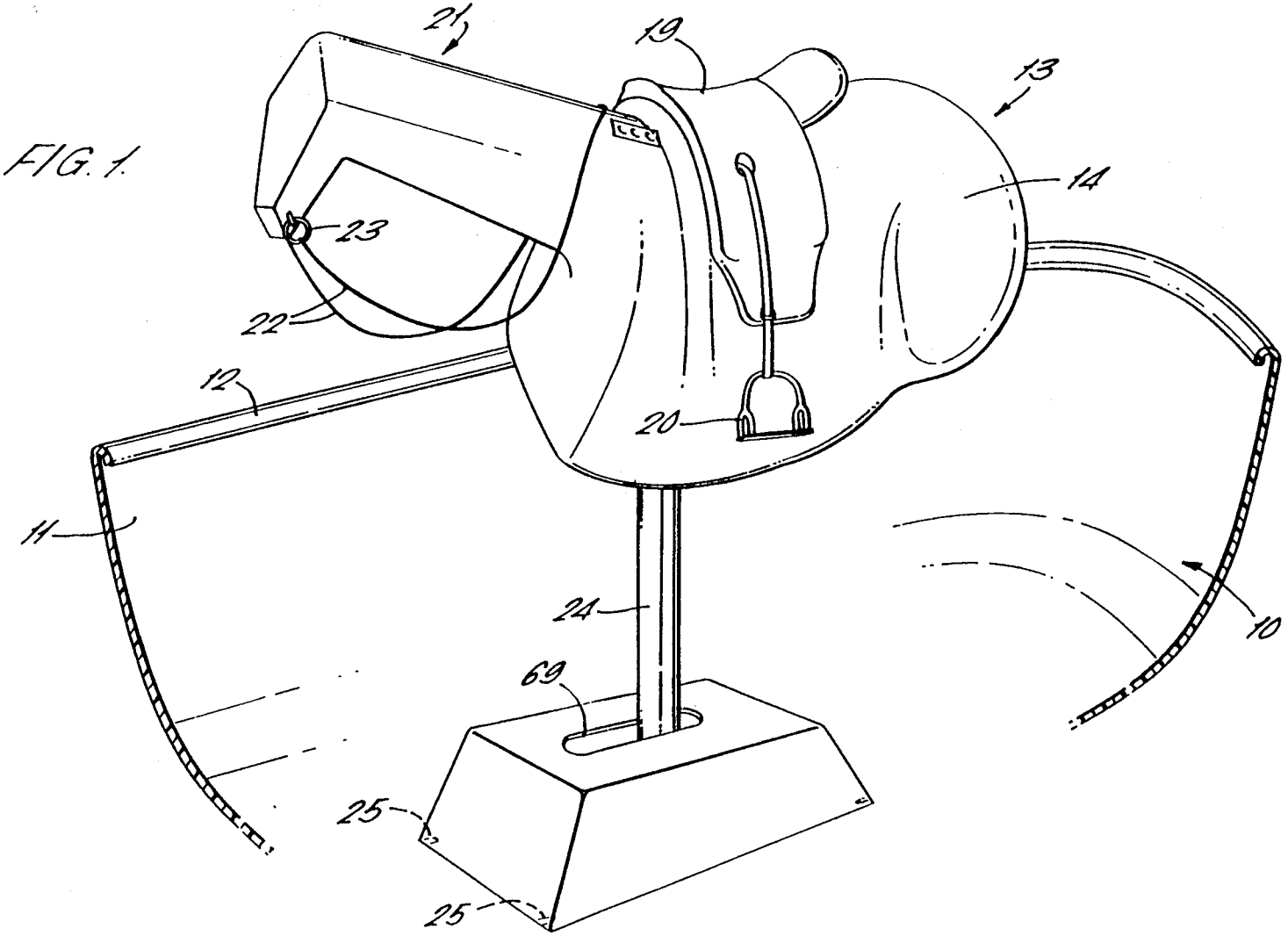
FIG. 1 is a perspective view of a workout horse and part of a practice surface area suitable for use by a polo player.

This example concerns a workout horse for particular use by polo players or potential polo players. As with a conventional, stationary workout horse, the horse is stood or fixed generally centrally of a dish-shaped practice surface area. A rider on the horse then practices hitting polo balls over the surface which by virtue of its contour retains the balls within the confines of the surface area and tends to return them towards the horse.

With reference to FIGS. 1 to 7, the practice surface area 10 is of conventional design and in this embodiment is formed of reinforced glass fibre. The surface has an upstanding peripheral rim 11 with an inwardly projecting lip 12 to retain the polo balls on the surface area, and also slopes generally towards its centre. If desired the rim could additionally have protective netting around its periphery.

The workout horse 13 is positioned, for example, at the centre of the practice surface 10. The horse comprises a body portion 14 on which the rider sits and a stationary base frame 15 which, in this embodiment, is fixed to the ground by bolts 35 (FIGS. 3 and 4) and protected by a cover 16 which is held in position by corner clips 25. Other fixing means for the cover 16 may be employed if desired. Under the base portion cover 16 is a drive mechanism 17 to move the body portion 14 relative to the base frame 15 in a manner which so far as possible simulates the natural cantering movement of a polo pony.

The body portion 14 has a main portion 18 carrying a saddle 19 and stirrups 20 and, in this embodiment, an integral neck and head portion 21 with reins 22 attached to mouth bit rings 23. Also, in this embodiment, the saddle 19 is formed integrally with the main portion 18 as a moulding of reinforced glass fibres or other suitable plastics material. The base portion cover 16 is also a similar moulding.

The body portion 14 includes a metal support column 24 which at its upper end is rigidly attached to the inside of the moulded main portion 18. The lower end of the column 24 passes through an oval shaped aperture 69 in the cover 16 and is mounted on a substantially central intermediate transverse member 26 of an upper movable support frame 27. The column passes through an aperture in the transverse member 26 and is attached to the transverse member by a flanged support member 32 which is bolted to the undersurface of the transverse member. Spaced apart longitudinal members 28 of the upper frame 27 are also connected by end transverse members 29. The intermediate transverse member 26 is attached to the longitudinal members 28 by bolts 30, and further threaded holes 31 are provided in the longitudinal members so that, if desired, the position of the intermediate transverse member 26 can be adjusted longitudinally of the frame 27. The upper frame 27 thereby carries the body portion 14 for movement therewith.

Both ends of the upper frame 27 are linked to respective ends of the stationary base frame 15 which likewise has spaced apart longitudinal members 33 and end transverse members 34. The base frame 15 is fixed to the ground by the above-mentioned bolts 35 passing through holes in the transverse members 34 and rubber pads 36. Mounted on the base frame 15 is an electric motor 37 for driving the output shaft 38 of a reduction gear box 39, the shaft 38 extending transversely of the base frame. The gear box 39 is centrally bolted to the base frame 15 employing four mounting blocks 62 and two further transverse members 63.

Figure 2:
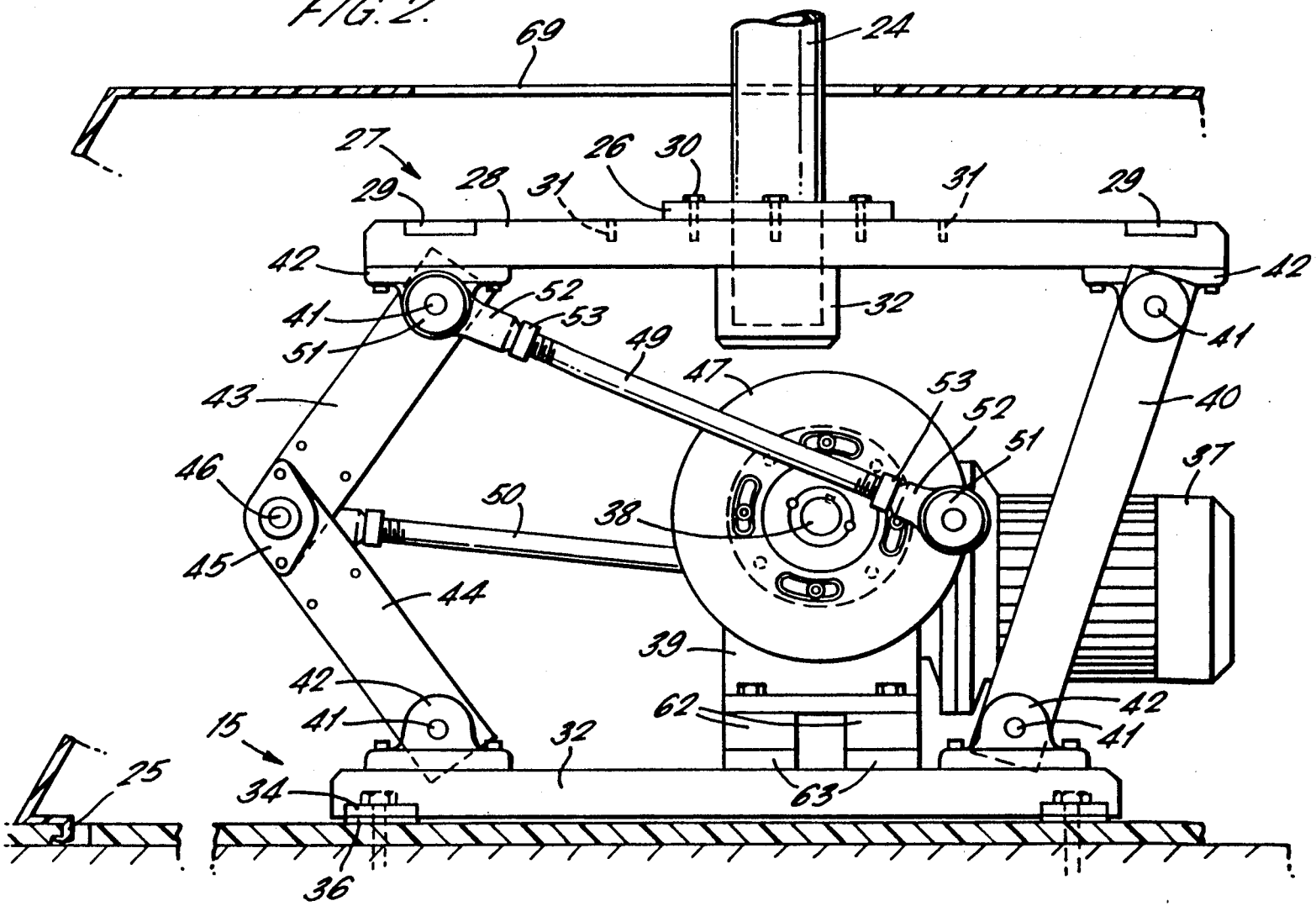
FIG. 2 is a side elevation of the drive means within the base portion of the workout horse of FIG. 1.
Figure 3:
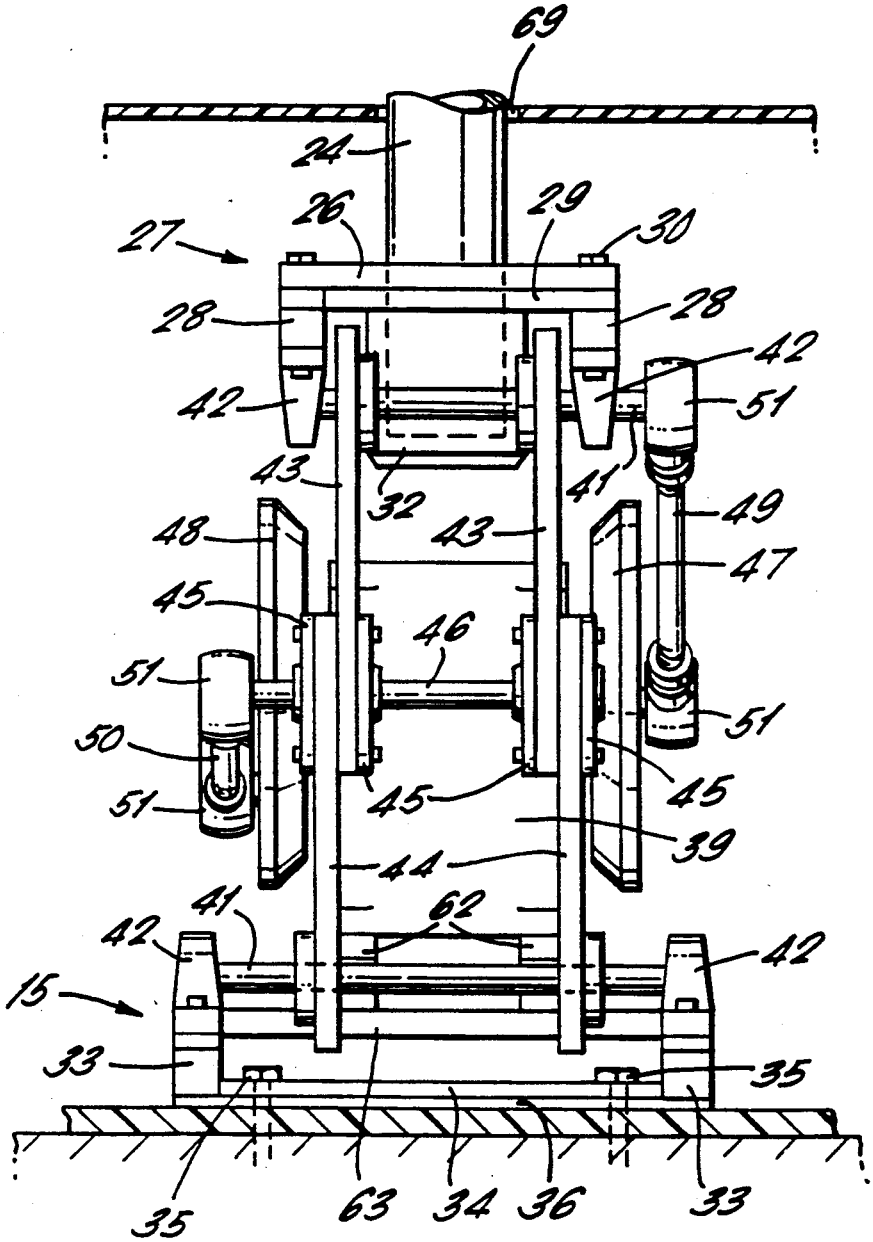
FIG. 3 is a front elevation of the drive means in the head of the workout horse of FIG. 1.
Figure 4:
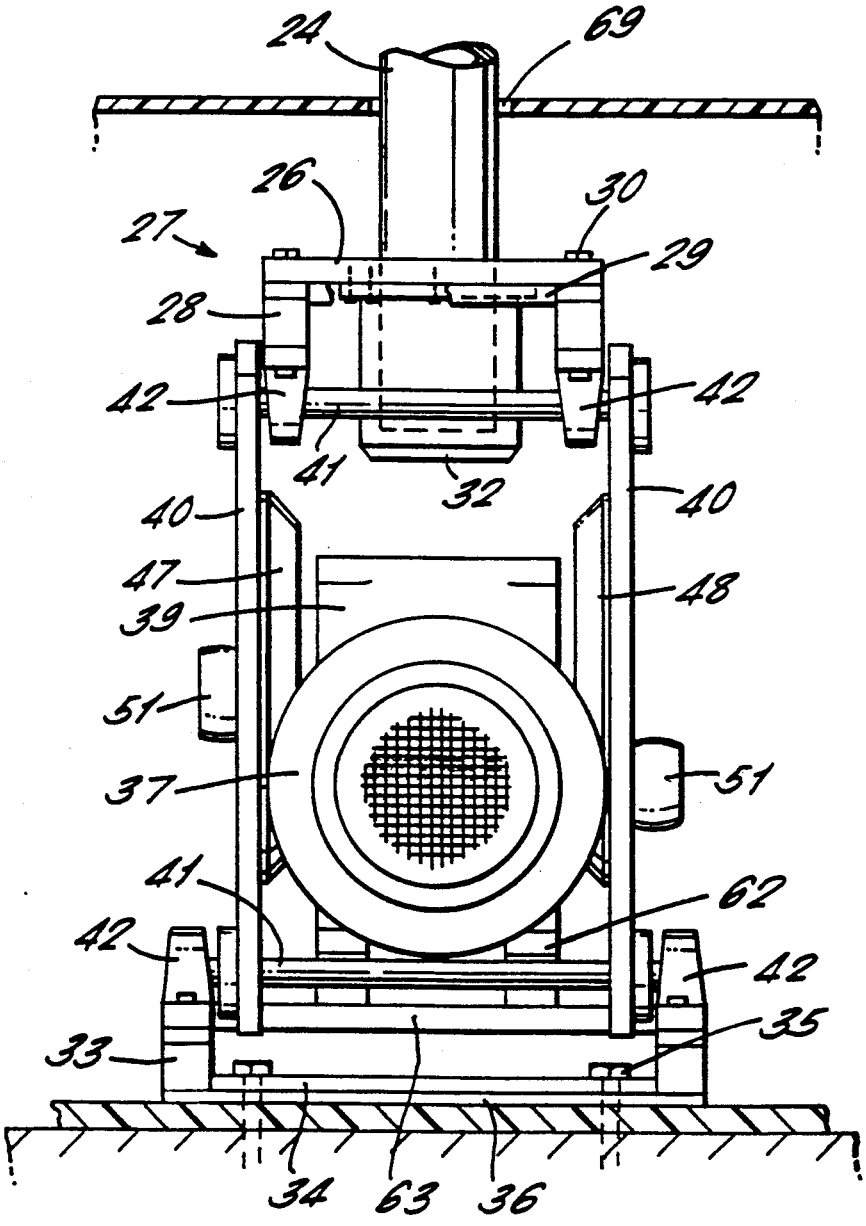
FIG. 4 is a rear elevation of the drive means.
Figure 5:
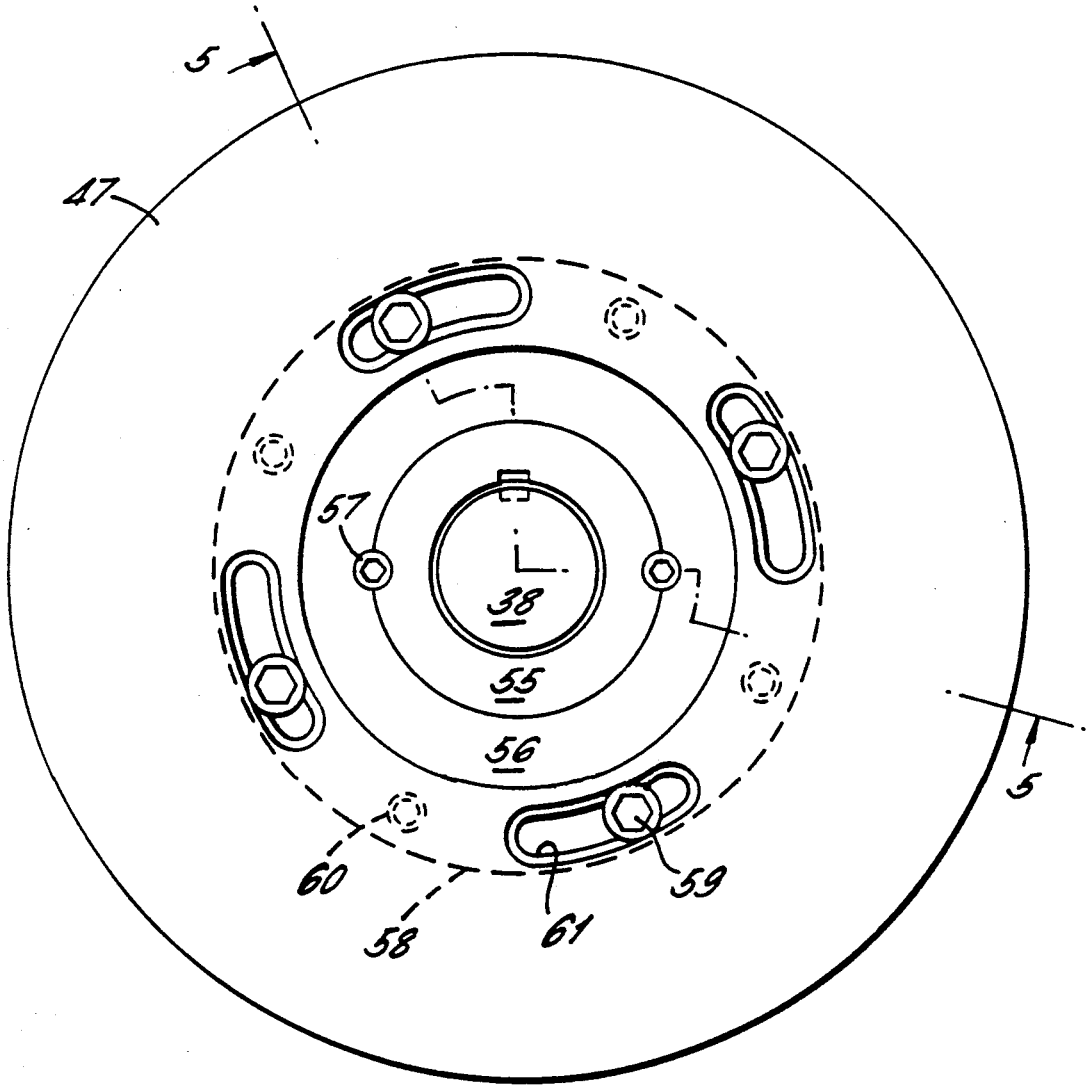
FIG. 5 is an enlarged side elevation of the crank wheel seen in FIG. 2.
Figure 6:
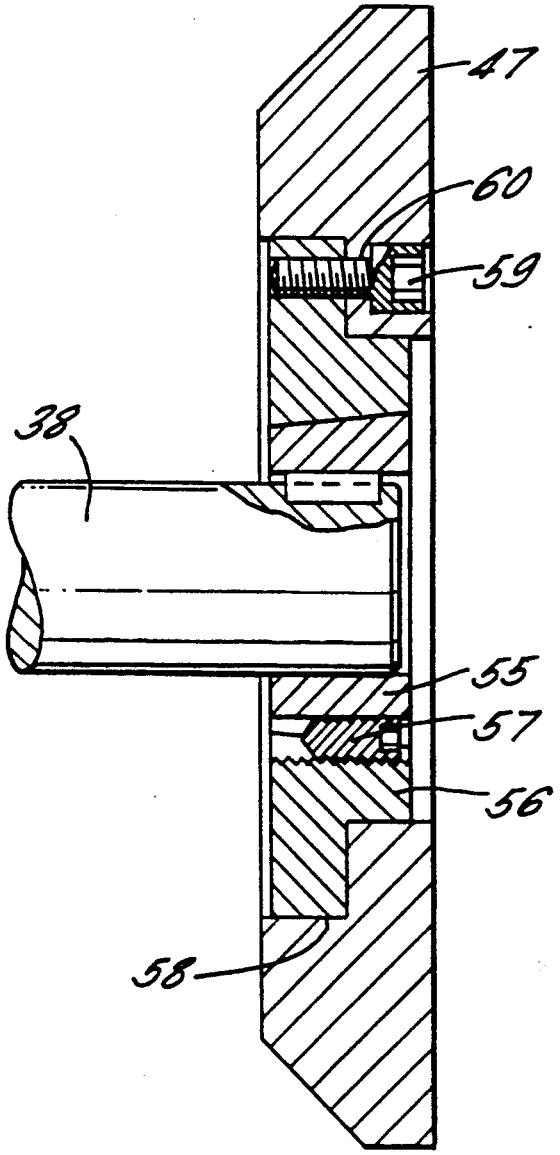
FIG. 6 is a section along line 5—5 in FIG. 5.

The rear ends of the base frame 15 and the upper frame 27 are linked by two identical rigid links 40. The ends of each link 40 are carried on shafts 41 extending between bearing blocks 42 bolted on the longitudinal members of the respective frame (FIGS. 2 and 4) Similarly mounted shafts 41 at the front ends of the two frames are linked by a linkage comprising two pairs of links 43, 44 (FIGS. 2 and 3). Attached to the adjacent ends of each pair of links 43, 44 are face bearings 45 carried on a common shaft 46. In this embodiment, the bearing blocks 42 and face bearings 45 are R.H.P. ball race type bearings.

The upper frame 27 is thus reciprocable longitudinally of the base frame 15 and the front end of the upper frame can be moved vertically up and down relatively to the rear end of the upper frame. For effecting this movement, two crank wheels 47, 48 are mounted on the output shaft 38 of the gear box 39 between the rear links 40 and the front pairs of links 43, 44. The crank wheel 47 on the right-hand side as viewed in FIGS. 3 and 5 has a connecting rod 49 pivotally mounted at one end by an eye end ball race bearing to the crank wheel, and its other end pivotally mounted by a similar bearing on an extension of the shaft 41 at the front end of the upper frame. Screw threaded terminal blocks 52 on the connecting rod 49 allow a degree of length adjustment which is then locked by a locking ring 53. Rotation of the crank wheel 47 will thereby effect longitudinal movement of the upper frame 27 relative to the base frame 15.

Figure 7:
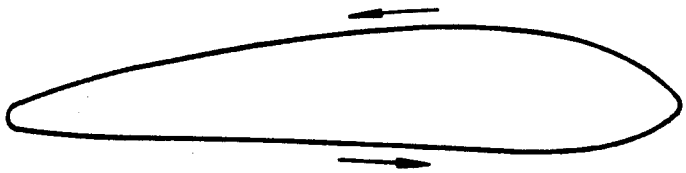
FIG. 7 shows the rotary path of the body portion effected by the drive means of FIG. 2.

The other crank wheel 48 has a similar connecting rod 50 pivotally mounted at one end to the crank wheel, and its other end pivotally mounted on an extension of the shaft 46 interconnecting the pairs of front links 43, 44. Rotation of the crank wheel 48 will thereby effect vertical movement of at least the front end of the upper frame 27 relative to the base frame 15. Accordingly, rotation of both crank wheels 47, 48 simultaneously reciprocates the upper frame 27 and hence the body portion 14 of the horse 13 forwards and backwards along an intended rotary path. In this embodiment, the rotary path achieved is illustrated in FIG. 7.

The use of twin cranks results in such an irregular rotary path, rather than a reciprocal motion with identical forward and return movements which would result from a single crank. Moreover, in this embodiment, the angular adjustment between the two crank wheels is infinitely adjustable. Similarly, the throw of each crank and the length of the respective connecting rod are adjustable either individually or in combination giving a variety of resulting motions.

As shown in FIG. 2, connecting rod 49 effecting longitudinal movement of the upper frame 27 is mounted on the associated crank wheel 47 substantially at the periphery of the crank wheel, whilst the corresponding end of the other connecting rod 50 is mounted radially closer to the centre of the crank wheel 48. This has the effect of reducing the vertical movement effected by the forward links 43, 44 compared with mounting the connecting rod 50 nearer the periphery of the crank wheel 48.

The means for mounting the two crank wheels 47, 48 on the gearbox output shaft 38 are also slightly different. As shown in FIG. 2, each crank wheel is keyed onto the shaft by key 54 and is locked onto the shaft by a known form of tapered housing in which concentric parts 55, 56 are expanded by rotation of grub screws 57, the radially outer part 56 having a shoulder 58 which is bolted by four bolts 59 to the crank wheel. In the case of the crank wheel 48, these four bolts are not illustrated but engage in respective threaded holes in the crank wheel, which could be mounted in any one of four alternative positions relative to the position of the respective key 54. However, in this embodiment, the four mounting bolts 59 for the other crank wheel 47 have eight alternative holes 60 in the outer part 56 of the tapered housing, and each bolt engages an arcuate slot 61 having a length equivalent to 30° relative to the centre of the shaft 38. Thereby the rotary position of the crank wheel 47 relative to that of the crank wheel 48 is infinitely adjustable.

In this embodiment, the electric motor 37 is a 2.2. Kw 3 phase motor controlled by a variable speed AC drive inverter, using single phase input and giving 3 phase output with variable frequency allowing up to five preset speeds with programmable ramp up and ramp down times to give a soft start and stop characteristic. The gear box 39 also gives a reduction of 30:1.

In operation, rotation of the crank wheels 47, 48 by the motor 37 drives the connecting rods 49, 50 to effect a longitudinal/vertical movement to the upper frame 27 and thereby the body portion 14 on which the rider sits. As described above, the intended rotary path of this reciprocating movement may be varied as desired, whilst in this embodiment it is adjusted to simulate as closely as possible the natural smooth cantering movement of a polo pony.

Figure 8:
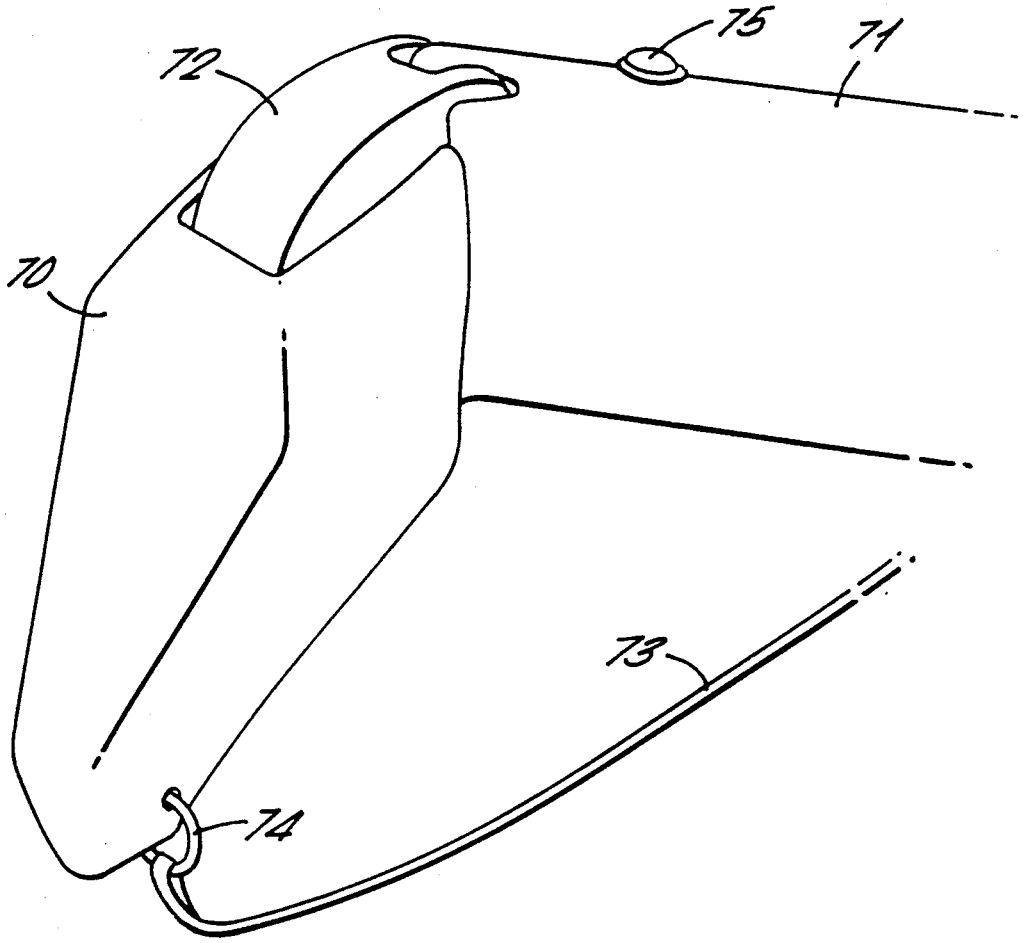
FIG. 8 is a perspective view of part of a modified workout horse.

FIG. 8 illustrates part of a modified embodiment of workout horse which is identical to the workout horse of FIGS. 1 to 7 except that it has a head portion 70 which is pivotally connected to the neck portion 71. The head portion 70 may be arranged to pivot about a vertical axis or a horizontal axis. However, in this modified embodiment, the head portion 70 is able to pivot about both a vertical axis and a horizontal axis by means of the compound joint 72. Pivoting action of the head portion relative to the neck portion is controlled by the rider through the reins 73 which are attached by a single bit ring 74. Pivotal movement of the head portion 70 beyond a predetermined limit operates a pressure switch connected to switch on or to flash an indicator light 75 in the neck portion at a position which is visible to the rider. When the rider hits a ball, he has the tendency to pull on the reins. If the amount of pull is excessive, a real polo pony would tend to pull up which is obviously undesirable. The indicator light thus acts as a device for teaching the rider on the workout horse not to pull on the reins to an excessive amount when hitting a ball.

The size of the body portion 14 and the speed control means for the electric motor 34 may be readily adapted to suit a polo player of any ability or age.

Although the workout horse has been described as simulating the natural smooth cantering movement of a polo pony, it is also envisaged that the longitudinal/vertical action of the drive means may be altered so that the body portion simulates a different type of horse movement.

The workout horse may also be used without the practice surface area 10, if desired.

We claim:

1. A workout horse comprising a stationary base frame, a body portion on which a rider sits mounted on an upper support which is movable relative to the base frame, and drive means interconnecting the base frame and the upper support for continuously reciprocating the upper support and thereby the body portion forwards and backwards relative to the base frame along an intended rotary path, wherein for providing the body portion with the simulated movement of a horse at one end of the upper movable support a rigid link is pivotally connected between the upper support and the base frame, the other end of the upper support being supported above the base frame by a separate linkage spaced from the rigid link in the direction of movement of the upper support, and the drive means is mounted offset from the linkage in said direction of movement and comprises two cranks driven by an electric motor, the first crank being connected directly to the upper support to effect said reciprocal motion of the upper support, and the second crank being connected to said linkage between the upper support and the base frame whereby substantially horizontal driving movement of the second crank effects vertical extension or contraction of the linkage thereby changing the attitude of the upper support relative to the base frame, the combined action of the first and second cranks effecting a movement of the upper support and thereby the body portion which simulates the movement of a horse.

2. A workout horse as claimed in claim 1, wherein said linkage comprises a pair of links pivotally attached to the upper support and the base frame respectively and pivotally connected together about a transverse axis disposed between the upper support and the base frame, and on which axis said pair of links are pivotally attached to the second crank.

3. A workout horse as claimed in claim 1, wherein the two cranks comprise crank wheels mounted on a common output shaft of the electric motor, the first crank wheel having a connecting rod pivotally connected at its free end to the upper support, and the second crank wheel having a connecting rod pivotally connected to said linkage.

4. A workout horse as claimed in claim 3, wherein the relative rotary position of the two crank wheels on the common shaft is infinitely adjustable.

5. A workout horse as claimed in claim 1, wherein the drive means is mounted on the base frame between said link and said linkage.

6. A workout horse as claimed in claim 1, wherein the horse is for use by polo players and the drive means effects a movement of the upper support and thereby the body portion which simulates the natural cantering movement of a polo pony.

7. A workout horse as claimed in claim 1, wherein the body portion is carried on a support column extending upwardly from the upper support.

8. A workout horse as claimed in claim 1, wherein the body portion has a main portion on which the rider sits, a neck portion integral with the main portion and a head portion pivotally mounted on the end of the neck portion, reins for pivoting the head portion, and indicator means which indicate to the rider when the head portion is pivoted beyond a predetermined limit.

9. A workout horse as claimed in claim 1, in combination with a dish shaped surface on which the horse is fixed to enable the rider to practice hitting an object over the surface, the contour of the surface being designed to retain the objects within the confines of the surface and to return the objects towards the horse.

* * * * *